US009827803B2

(12) United States Patent
Schiffmann

(10) Patent No.: US 9,827,803 B2
(45) Date of Patent: Nov. 28, 2017

(54) SECURITY PAPER, VALUE DOCUMENT OBTAINABLE THEREFROM AND METHOD FOR MANUFACTURING SAID PAPER AND DOCUMENT

(71) Applicant: GIESECKE & DEVRIENT GMBH, Munich (DE)

(72) Inventor: Peter Schiffmann, Munich (DE)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 276 days.

(21) Appl. No.: 14/361,380

(22) PCT Filed: Nov. 29, 2012

(86) PCT No.: PCT/EP2012/004938
§ 371 (c)(1),
(2) Date: May 29, 2014

(87) PCT Pub. No.: WO2013/083253
PCT Pub. Date: Jun. 13, 2013

(65) Prior Publication Data

US 2014/0319816 A1 Oct. 30, 2014

(30) Foreign Application Priority Data

Dec. 9, 2011 (DE) ..... 10 2011 120 850

(51) Int. Cl.
*B42D 25/20* (2014.01)
*B42D 25/405* (2014.01)
(Continued)

(52) U.S. Cl.
CPC ..... *B42D 25/20* (2014.10); *B41M 3/14* (2013.01); *B42D 25/00* (2014.10); *B42D 25/324* (2014.10);
(Continued)

(58) Field of Classification Search
None
See application file for complete search history.

(56) References Cited

U.S. PATENT DOCUMENTS 4,830,902 A 5/1989 Plantenga et al.
4,892,336 A 1/1990 Kaule et al.
(Continued)

FOREIGN PATENT DOCUMENTS

CA 2446559 A1 11/2002
CA 2515420 A1 8/2004
(Continued)

OTHER PUBLICATIONS

International Search Report for corresponding International PCT Application No. PCT/EP2012/004938, dated Mar. 12, 2013.
(Continued)

*Primary Examiner* — Laura Powers
(74) *Attorney, Agent, or Firm* — Workman Nydegger

(57) ABSTRACT

A security paper for manufacturing value documents has a planar substrate equipped on one surface with an anti-forgery means based on a carrier foil having an optically variable security feature. The anti-forgery means and a partial substrate area surrounding the anti-forgery means is furnished with a dirt-repellent radiation-curing first lacquer substantially not influencing the perceptibility of the optically variable security feature. The layer thickness of the lacquer lying is in a range of 0.7 to 2 micrometers. The radiation-curing first lacquer is may be a UV-cross-linking lacquer which after cross-linking is high-gloss. The substrate can be furnished on its surface lying outside the anti-forgery means with a dirt-repellent second lacquer and optionally partly overlaps the first lacquer in the region of the partial substrate area surrounding the anti-forgery means. The second lacquer involves either a physically
(Continued)

drying, water-based dispersion lacquer, or a UV-cross-linking lacquer, and has a matt impression.

9 Claims, 2 Drawing Sheets

(51) Int. Cl.

| | |
|---|---|
| ***B42D 25/378*** | (2014.01) |
| ***B42D 25/36*** | (2014.01) |
| ***B42D 25/324*** | (2014.01) |
| ***B42D 25/355*** | (2014.01) |
| ***B42D 25/00*** | (2014.01) |
| ***B42D 25/328*** | (2014.01) |
| ***B42D 25/29*** | (2014.01) |
| ***B41M 3/14*** | (2006.01) |
| ***B41M 7/00*** | (2006.01) |

(52) U.S. Cl.
CPC ..... *B42D 25/328* (2014.10); *B42D 25/355* (2014.10); *B42D 25/36* (2014.10); *B42D 25/378* (2014.10); *B42D 25/405* (2014.10); *B41M 7/0036* (2013.01); *B41M 7/0045* (2013.01); *B42D 25/29* (2014.10); *B42D 2033/04* (2013.01); *B42D 2033/18* (2013.01); *B42D 2033/24* (2013.01); *B42D 2033/30* (2013.01); *B42D 2033/32* (2013.01)

(56) References Cited

U.S. PATENT DOCUMENTS

| | | | | |
|---|---|---|---|---|
| 5,759,420 | A | 6/1998 | Minnetian et al. | |
| 5,868,902 | A | 2/1999 | Howland et al. | |
| 6,474,695 | B1 | 11/2002 | Schneider et al. | |
| 6,562,755 | B1 * | 5/2003 | Halbrook, Jr. ..... | B41M 3/142 503/200 |
| 7,744,129 | B2 | 6/2010 | Heim | |
| 2007/0017647 | A1 | 1/2007 | Habik et al. | |
| 2007/0114787 | A1 | 5/2007 | Heim | |
| 2008/0106091 | A1 * | 5/2008 | Tompkin ..... | G07D 7/0013 283/91 |
| 2008/0160226 | A1 | 7/2008 | Kaule et al. | |
| 2009/0008458 | A1 * | 1/2009 | Vast ..... | D21H 21/48 235/491 |
| 2012/0153607 | A1 | 6/2012 | Rahm et al. | |
| 2012/0319395 | A1 | 12/2012 | Fuhse et al. | |

FOREIGN PATENT DOCUMENTS

| | | | |
|---|---|---|---|
| DE | 3609090 | A1 | 9/1987 |
| DE | 10124630 | A1 | 11/2002 |
| DE | 102005028162 | A1 | 12/2006 |
| DE | 102009035361 | A1 | 2/2011 |
| EP | 0064067 | A1 | 11/1982 |
| EP | 0238043 | A2 | 9/1987 |
| EP | 0330733 | A1 | 9/1989 |
| EP | 0256170 | B2 | 9/1995 |
| EP | 0758587 | A1 | 2/1997 |
| EP | 0815321 | B1 | 11/1999 |
| EP | 1338430 | A1 | 8/2003 |
| EP | 1595029 | B1 | 5/2011 |
| WO | 2000000697 | A1 | 1/2000 |
| WO | 2004072378 | A1 | 8/2004 |
| WO | 2004097112 | A1 | 11/2004 |
| WO | 2006087138 | A1 | 8/2006 |
| WO | 2011066991 | A2 | 6/2011 |

OTHER PUBLICATIONS

"Römpp-Lexikon Lacke and Druckfarben", Georg Thieme Verlag, 1998, p. 372.

* cited by examiner

SECURITY PAPER, VALUE DOCUMENT OBTAINABLE THEREFROM AND METHOD FOR MANUFACTURING SAID PAPER AND DOCUMENT

BACKGROUND

This invention relates to a security paper for manufacturing value documents, such as bank notes, passports, identity documents or the like, having a planar substrate which is equipped on at least one surface with at least one anti-forgery means, the anti-forgery means being furnished with a lacquer for extending life and fitness for circulation. The invention relates furthermore to a value document having such a security paper and to methods for manufacturing the security paper and the value document.

SUMMARY

Value documents, such as for example bank notes, shares, bonds, deeds, vouchers, checks, high-value admission tickets, but also other papers at risk of forgery, such as passports or other identity documents, are often furnished for safeguarding purposes with anti-forgery means which permit a test of the authenticity of the value document and which at the same time serve as protection from unauthorized reproduction. The anti-forgery means can be present for example in the form of a security thread embedded wholly or partly in a bank note, or in the form of a security strip applied to the bank note or of a patch.

In recent years, anti-forgery means, in particular security threads, having optically variable security features have become established on the bank-note market. Optically variable security features convey a different pictorial impression to the viewer from different viewing angles. The security features can be present here in the form of optically-diffractively active micro- or nanostructures, such as in the case of conventional embossed holograms or other hologram-like diffractive structures (see e.g. the prints EP 0 330 733 A1 or EP 0 064 067 A1).

It is also known to use lens systems as security features. Thus, the print EP 0 238 043 A2 or DE 36 09 090 A1, for example, describes a security thread made of a transparent material having embossed into its surface a grid consisting of a plurality of parallel cylindrical lenses. The thickness of the security thread is so chosen here that it corresponds approximately to the focal length of the cylindrical lenses. On the opposing surface a printed image is applied in exact register, the printed image being designed with consideration of the optical properties of the cylindrical lenses.

For some time, so-called moiré magnification arrangements have also been used as security features. Such a moiré magnification arrangement is disclosed in the print WO 2006/087138 A1 or in DE 10 2005 028 162 A1. The anti-forgery means disclosed in WO 2006/087138 A1 has at least a first and a second security feature. The first authentication feature comprises a first arrangement having a multiplicity of focusing elements which are present in a first grid, as well as a second arrangement having a multiplicity of microscopic structures which are present in a second grid. The first and second arrangements are disposed relative to each other such that the microscopic structures of the second arrangement are to be seen magnified upon viewing through the focusing elements of the first arrangement. Such a magnification effect is also designated moiré magnification. To put it briefly, moiré magnification thus designates a phenomenon that occurs upon viewing of a grid consisting of identical image objects through a lenticular grid having approximately the same grid pitch. As with every pair of similar grids, this results in a moiré pattern, whereby in this case each of the moiré strips appears in the form of a magnified and rotated image of the repeated elements of the image grid.

It is also known to use optically variable security features based on periodic or aperiodic sawtooth gratings (see e.g. WO 2011/066991 A2).

For extending life and fitness for circulation, papers of value can be furnished with a dirt-repellent protective layer. For example, the print EP 0 256 170 B2 proposes furnishing printed bank bills with a protective layer that contains cellulose ester or cellulose ether for the greater part and micronized wax for a lesser part and that is applied over the full area of the bank bills. The micronized wax is dispersed by kneading or mixing with oil, an ink binder or a mixture thereof. The sheets freshly printed with the protective layer can be stacked without difficulties, without black ink from one sheet coming off onto the sheet therebelow.

Optically variable anti-forgery means, in particular security elements having a micro-optic representation arrangement having microstructures as well as micro-imaging elements for magnified imaging of the microstructures, e.g. microlens arrays or concave micromirror arrays, cannot be furnished with a dirt-repellent protective layer due to a possible impairment of the optical effect. Partially applying a dirt-repellent protective layer to a bank bill equipped with an optically variable anti-forgery means such that the protective layer has a gap in the region of the anti-forgery means leads in circulation to bothersome smudges in the region of the gap (in particular in the case of a windowed thread).

On these premises, the invention is based on the object of avoiding the disadvantages of the prior art and in particular stating a security paper that has improved dirt repellence in the region of the optically variable anti-forgery means and at the same time guarantees an attractive visual appearance of the anti-forgery means.

This object is achieved by the feature combinations defined in the independent claims. Developments of the invention are the subject matter of the subclaims.

SUMMARY OF THE INVENTION

A first aspect of the invention relates to a security paper for manufacturing value documents, such as bank notes, passports, identity documents or the like, having a planar substrate which is equipped on at least one surface with at least one anti-forgery means, wherein the anti-forgery means is based on a carrier foil having mutually opposing first and second principal areas, and the carrier foil's first principal area visually recognizable to the viewer at least in some regions and opposing the substrate has an optically variable security feature, and the anti-forgery means and a partial substrate area surrounding the anti-forgery means is furnished, for extending life and fitness for circulation, with a dirt-repellent radiation-curing first lacquer substantially not influencing the perceptibility of the optically variable security feature, the layer thickness of said lacquer lying in a range of 0.7 to 2 μm The first lacquer can in particular contain an additional feature substance, in particular luminescent substance, substantially not influencing the perceptibility of the optically variable security feature. Suitable luminescent substances are e.g. nanoscale luminescent substances. The luminescent substance can be detectable e.g. in the UV region. In particular, the first lacquer furnished with a luminescent substance can have at least on its edges at least partly a special design or pattern.

The anti-forgery means can be present in particular in the form of a security strip, of a security thread (e.g. of a windowed thread) or of a patch.

The radiation-curing first lacquer is preferably a UV-cross-linking lacquer, which after cross-linking is high-gloss, i.e. has only very little scattering and thus only very low matting. Such a cross-linked UV lacquer can be obtained from a UV-cross-linking lacquer that contains no matting agents and has only very low scattering and thus only very low matting after drying due to its lacquer composition.

The substrate can be furnished on its surface lying outside the anti-forgery means with a water-based primer layer which optionally partly overlaps the stated dirt-repellent radiation-curing first lacquer substantially not influencing the perceptibility of the optically variable security feature, in the region of the partial substrate area surrounding the anti-forgery means. The primer layer can, according to one alternative, be disposed in spaced relationship to the anti-forgery means (so that no overlapping arrangement relative to the first lacquer is present). The primer layer can, according to a further alternative, be present over the full area, and the anti-forgery means (e.g. a patch or a strip) be disposed above the primer layer. The primer layer can optionally be furnished with a UV-cross-linking lacquer forming a cover layer, which protects the substrate from physical and chemical influences.

Alternatively, the substrate can be furnished on its surface lying outside the anti-forgery means with a dirt-repellent second lacquer which optionally partly overlaps the stated dirt-repellent radiation-curing first lacquer substantially not influencing the perceptibility of the optically variable security feature, in the region of the partial substrate area surrounding the anti-forgery means, and either (a) involves a physically drying, water-based dispersion lacquer which can optionally contain cross-linking agent and after drying has a matt impression, in particular has a gloss of less than 20 gloss units, preferably less than 15 gloss units at 60°, measured by means of gloss meters according to DIN standard 67530, or (b) involves a UV-cross-linking lacquer which after cross-linking has a matt impression, in particular has a gloss of less than 20 gloss units, preferably less than 15 gloss units at 60°, measured by means of gloss meters according to DIN standard 67530.

It is preferred that the dirt-repellent second lacquer involves a physically drying, water-based dispersion lacquer which cures through removal of the dispersant and is an aqueous dispersion of a polyacrylic resin and/or of a polyurethane resin.

A second aspect of the invention relates to a value document, such as a bank note, a passport, an identity document or the like, having a security paper according to the first aspect of the invention, wherein the substrate is printed with signs or patterns on its surface lying outside the anti-forgery means, in particular in the case of the presence of the optionally present dirt-repellent second lacquer or of the optionally present water-based primer layer, on the surface of said lacquer or said layer.

It is preferred that the substrate is furnished on its surface lying outside the anti-forgery means with a water-based primer layer which optionally partly overlaps the stated dirt-repellent radiation-curing first lacquer substantially not influencing the perceptibility of the optically variable security feature, in the region of the partial substrate area surrounding the anti-forgery means (or the primer layer is disposed in spaced relationship to the first lacquer, or the primer layer is present over the full area and the anti-forgery means is disposed on the primer layer), wherein the primer layer is printed with signs or patterns, and the primer layer is furnished with a UV-cross-linking third lacquer forming a cover layer, which protects the substrate from physical and chemical influences. The UV-cross-linked third lacquer can optionally also be printed with signs or patterns (e.g. a numbering can be imprinted).

A third aspect of the invention relates to a method for manufacturing a security paper, in particular for a value document, such as a bank note, a passport, an identity document or the like, comprising making available a planar substrate which is equipped on at least one surface with at least one anti-forgery means, wherein the anti-forgery means is based on a carrier foil having mutually opposing first and second principal areas, and the carrier foil's first principal area visually recognizable to the viewer at least in some regions and opposing the substrate has an optically variable security feature; and applying a dirt-repellent radiation-curing first lacquer suitable for extending life and fitness for circulation and substantially not influencing the perceptibility of the optically variable security feature, having a layer thickness in a range of 0.7 to 2 μm, to the anti-forgery means and a partial substrate area surrounding the anti-forgery means.

It is preferred that the anti-forgery means is present in the form of a security strip, of a security thread or of a patch.

It is preferred that the radiation-curing first lacquer is a UV-cross-linking lacquer which after cross-linking is high-gloss.

The method preferably comprises the additional step of applying a water-based primer layer to the substrate surface lying outside the anti-forgery means in such a manner that the stated dirt-repellent radiation-curing first lacquer substantially not influencing the perceptibility of the optically variable security feature is overlapped optionally partly by the water-based primer layer in the region of the partial substrate area surrounding the anti-forgery means. The primer layer can, according to one alternative, be disposed in spaced relationship to the anti-forgery means (so that no overlapping arrangement relative to the first lacquer is present). The primer layer can, according to a further alternative, be applied over the full area in a first step, and the anti-forgery means (e.g. a patch or a strip) be disposed above the primer layer in a second step.

The method can alternatively, according to a further preferred embodiment, comprise the additional step of applying a dirt-repellent second lacquer to the substrate surface lying outside the anti-forgery means in such a manner that the stated dirt-repellent radiation-curing first lacquer substantially not influencing the perceptibility of the optically variable security feature is overlapped optionally partly by the dirt-repellent second lacquer in the region of the partial substrate area surrounding the anti-forgery means, wherein the dirt-repellent second lacquer either (a) involves a physically drying, water-based dispersion lacquer which can optionally contain cross-linking agent, and after drying has a matt impression, in particular has a gloss of less than 20 gloss units, preferably less than 15 gloss units at 60°, measured by means of gloss meters according to DIN standard 67530, or (b) involves a UV-cross-linking lacquer which after cross-linking has a matt impression, in particular has a gloss of less than 20 gloss units, preferably less than 15 gloss units at 60°, measured by means of gloss meters according to DIN standard 67530.

It is preferred that the dirt-repellent second lacquer involves a physically drying, water-based dispersion lacquer which cures through removal of the dispersant and is an aqueous dispersion of a polyacrylic resin and/or of a polyurethane resin.

A fourth aspect of the invention relates to a method for manufacturing a value document, such as a bank note, a passport, an identity document or the like, comprising making available a security paper according to the first aspect of the invention, and printing the substrate surface lying outside the anti-forgery means, in particular in the case of the presence of the optionally present dirt-repellent second lacquer or of the optionally present water-based primer layer, printing the surface of said lacquer or said layer, with signs or patterns.

The method preferably comprises making available the security paper having the above-described water-based primer layer, printing the surface of the water-based primer layer with signs or patterns, and furnishing the printed primer layer, in a further step, with a UV-cross-linking third lacquer forming a cover layer, which protects the substrate from physical and chemical influences.

DETAILED DESCRIPTION OF THE INVENTION

The invention is based on the finding that the dirt resistance of an optically variable anti-forgery means can be substantially improved, without recognizably worsening the optical effect of the anti-forgery means, in particular the light/dark contrast, the image sharpness and the magnification effect and movement effect, by applying a radiation-curing lacquer, which after cross-linking is high-gloss, in a small layer thickness of 0.7 to 2 μm, preferably 0.7 to 1.5 μm. Such a lacquer can be obtained from a UV-cross-linking lacquer that contains no matting agents and has only very low scattering and thus only very low matting after drying due to its lacquer composition.

The term "matting agent" designates according to "Römpp-Lexikon Lacke and Druckfarben", Georg Thieme Verlag, 1998, substances that influence the surface of a coating so as to reduce its degree of gloss. Matting agents can be of inorganic or organic origin. The former class includes e.g. amorphous preparations based on silicic acid or silicate, the latter includes stearates of Al, Zn, Ca or Mg as well as similarly structured compounds and, finally, products of the waxy type, e.g. micronized polypropylene waxes. Inorganic matting agents usually have an average grain size of 0.5 to 20 μm. Organic matting agents usually have an average grain size of 0.04 to 10 μm. In the present description the term "matting agent" is to be understood to refer to substances such as amorphous preparations based on silicic acid or silicate, stearates of Al, Zn, Ca or Mg, products of the waxy type or similar inorganic or organic substances that reduce the degree of gloss of the radiation-cured first lacquer to the same extent as the stated substances. Measurement of the degree of gloss, e.g. using devices of the reflectometer type, is known to the person skilled in the art (see e.g. gloss measurement according to DIN standard 67530 at a measurement angle of 60°).

The radiation-curing "first" lacquer can be in particular a UV-cross-linking lacquer, whereby this may be a radically or cationically cross-linking UV lacquer. The UV-cross-linking lacquer preferably has at least one monomeric acrylate (mono-, di-, tri- and/or tetrameric acrylate) as well as optionally additives or processing aids, such as defoamers, dispersing agents, UV cure accelerators, viscosity modifying agents, flow-promoting agents and stabilizers. The radiation-curing lacquer can consist in particular of a lacquer based on an acrylate mixture, with an acrylate mixture being preferred that is prepared by reacting at least one prepolymeric acrylate with an average molecular weight of e.g. 500 to 2000 with the monomeric acrylate (mono, di-, tri- and/or tetrameric acrylate), the lacquer containing 100 parts by weight of the acrylate lacquer (calculated without additive or processing aid) and 1 to 10 parts by weight of a UV initiator or UV initiator mixture, or consisting of these constituents. For UV curing it is suitable to use e.g. ultraviolet radiation in a range of 200 to 400 nm.

The radiation-curing "first" lacquer can be based in particular on mixtures of mono- and/or difunctional monomeric acrylates, prepolymeric acrylates, and tri- and/or tetrafunctional monomeric acrylates. As prepolymeric acrylates there can be used e.g. polyester acrylates, urethane acrylates, acrylacrylates and/or methacrylacrylates, oligoesteracrylates, epoxy acrylates, and/or mixtures of two or more of these prepolymeric acrylates.

An example of the composition of the radiation-curing first lacquer will be stated hereinafter:

Composition 1:

61.5 wt. % of polyester acrylate prepolymer ("Laromer PE 55 F" from BASF)

10 wt. % of trimethylolpropane triacrylate ("Laromer TMPTA" from BASF)

20 wt. % of hexanediol diacrylate ("Laromer HDDA" from BASF)

5 wt. % of photoinitiator ("Darocure 1173" from CIBA)

3 wt. % of reactive amine additive for accelerating UV curing ("Ebecryl P 115")

0.5 wt. % of defoamer ("Coatosil")

The radiation-curing first lacquer can be applied as a spot coating by the flexographic, offset or relief printing method. The application can be effected in the paper factory or in the printing works.

It is preferred to adjust the viscosity of the radiation-curing lacquer in a range of 30 to 150 sec, in particular 30 to 80 sec, efflux time according to DIN 4 cup at 20° C.

The anti-forgery means based on a carrier foil can be present e.g. in the form of a security strip, of a security thread or in the form of a label or patch. The optically variable security feature with which the anti-forgery means is furnished can be present e.g. in the form of optically-diffractively active micro- or nanostructures, such as in the case of conventional embossed holograms or other hologram-like diffractive structures (see e.g. the print EP 0 330 733 A1 or EP 0 064 067 A1). The security feature can in particular involve lens systems (see e.g. the prints EP 0 238 043 A2 and DE 36 09 090 A1) or concave micromirror arrays (see e.g. DE 10 2009 035 361 A1).

The anti-forgery means can be visually recognizable to the viewer completely or only in some regions. An example of an anti-forgery means visually recognizable only in some regions is a windowed security thread (e.g. a microlens thread) which emerges on the surface of a bank note in window regions while being embedded in the interior of the bank note in the bar regions therebetween (see e.g. FIG. 1 of WO 2004/097112 A1).

For reasons of application technology, the dirt-repellent radiation-curing first lacquer is not applied above the anti-forgery means in exact register, but rather the lacquer also covers a part of the security-paper substrate that surrounds the anti-forgery means and forms, so to speak, an edge region for the anti-forgery means (the formulation "the partial substrate area surrounding the anti-forgery means" that is employed herein stands as a substitute for the edge region). The anti-forgery means can be surrounded by the first lacquer all around, such as e.g. in the case of a patch-shaped anti-forgery means. In the case of a security thread or security strip extending from one edge of the bank note to the opposing edge, the anti-forgery means is surrounded by the first lacquer on two sides, i.e. the anti-forgery means and two elongate partial substrate areas bordering on the anti-forgery means are furnished with the first lacquer. The partial substrate area surrounding the anti-forgery means, i.e. the edge region, can have in particular a width of 0.3 to 10 mm, preferably 1 to 5 mm, measured from the outer edge of the anti-forgery means to the outer edge of the bordering partial substrate area.

With regard to extending the life and fitness for circulation of the security paper, it is in particular advantageous to furnish the security-paper substrate on its surface lying outside the anti-forgery means with a conventional dirt-repellent second lacquer which partly overlaps the dirt-repellent radiation-curing first lacquer in the region of the partial substrate area surrounding the anti-forgery means. If there is no overlap there is a danger of uncoated regions which, in circulation, lead to visible rims of dirt. The second lacquer can involve a physically drying, water-based dispersion lacquer which can optionally contain cross-linking agent and after drying has a matt impression, in particular has a gloss of less than 20 gloss units, preferably less than 15 gloss units at 60°, measured by means of gloss meters according to DIN standard 67530 (see e.g. the prints WO 00/00697, EP 0 815 321 B1 and EP 1 338 430 A1), or involve a UV-cross-linking lacquer which after cross-linking has a matt impression, in particular has a gloss of less than 20 gloss units, preferably less than 15 gloss units at 60°, measured by means of gloss meters according to DIN standard 67530. The lacquer can in particular contain matting agent. The presence of a matting agent improves the printability of the substrate. With regard to the lacquer components of the UV-cross-linking second lacquer, suitable lacquer components are e.g. those described hereinabove with reference to the first lacquer.

For forming the second lacquer, physically drying aqueous dispersions based on a polyacrylic resin and/or on a polyurethane resin are preferred. The lacquer can be based in particular on a one-component polyurethane system or one-component polyacrylate system with pre-cross-linked polyurethane or polyacrylate. However, there can also be used blocked polyurethane having isocyanate groups bound chemically to the polymer chains. The isocyanate groups can be regenerated at elevated temperatures, which are generally employed in security printing. There can furthermore be used two-component polyurethane systems or two-component polyacrylate systems which are cross-linkable by employing multifunctional reagents, such as melamine/formaldehyde precondensates. In general, the polyurethane can be in particular of the aliphatic polyester type and/or of the aliphatic polyether type. It is also possible to use aliphatic polycarbonate-polyurethane. The polyacrylate can be in general e.g. of the aromatic type, such as a styrene-acrylic copolymer. Mixtures of a polyurethane and a polyacrylate can be used e.g. in a weight ratio of 90:10 to 10:90, preferably 75:25 to 25:75. The physically drying aqueous dispersions can contain additional ingredients, such as catalysts, co-solvents, dispersing agents, defoamers, viscosity modifying agents, extenders, fluorescent and/or iridescent additives and/or surface-active substances. A typical physically drying aqueous dispersion has e.g. a polyurethane of the type of an aliphatic polyester or of an aliphatic polyether with a polyurethane content of 2 to 70 wt. %, preferably 5 to 30 wt. %.

The second lacquer can preferably be applied to the security paper by means of flexographic printing. In so doing, the lacquer layer is expediently applied in an amount of coating of 1 to 8 g/m$^2$. Examples of physically drying compositions of the second lacquer will be specified hereinafter, with matting agents being additionally contained (e.g. in a proportion of 1 to 20 wt. % based on the aqueous dispersion):

Composition 2:
900 ml of aqueous dispersion of an acrylate ("Neocryl-AC 72" from Zeneca)
80 ml of water
20 ml of cross-linker "CX 100" from Zeneca Composition 3:
900 ml of aqueous dispersion of an acrylate ("Primal 1-545" from Rohm & Haas)
80 ml of water
20 ml of zirconium carbonate from Auer-Remy Composition 4:
700 ml of aqueous dispersion of an acrylate-styrene copolymer ("Glascol LS 26" from CIBA)
200 ml of aqueous dispersion of a polyurethane ("U 400 N" from Alberdink Boley)
100 ml of water
20 ml of cross-linker "CX 100" from Zeneca According to a preferred embodiment, the security paper is printed with signs or patterns on the substrate surface lying outside the anti-forgery means in the course of the manufacture of a value document. Alternatively or additionally, a printed image can be imprinted on the second lacquer after the application of the dirt-repellent second lacquer.

With regard to extending the life and fitness for circulation of the security paper, the security-paper substrate can, according to a further, alternative preferred embodiment, be furnished on its surface lying outside the anti-forgery means with a water-based primer layer which optionally partly overlaps the dirt-repellent radiation-curing first lacquer in the region of the partial substrate area surrounding the anti-forgery means. The primer layer can, according to an alternative, be disposed in spaced relationship to the anti-forgery means (so that no overlapping arrangement relative to the first lacquer is present). The primer layer can, according to a further alternative, be present over the full area, and the anti-forgery means (e.g. a patch or a strip) be disposed above the primer layer. The primer layer serves as an adhesion promoter between the substrate and one or more layers disposed above the primer layer. Furthermore, the primer layer has a barrier effect for liquids. The water-based primer layer can, in a further step, be furnished with a UV-cross-linking lacquer forming a cover layer (the "third" lacquer). In the course of the manufacture of a value document, the water-based primer layer and/or the UV-cross-linked covering lacquer can be printed with a printed pattern in the form of signs and/or patterns.

Suitable water-based primer layers are known in the prior art (see e.g. EP 1 595 029 B1). Such a layer is in particular a physically drying lacquer layer which establishes contact with the substrate therebelow and closes its pores. The primer layer can be formed e.g. by a water-based dispersion lacquer layer. It is expediently applied on the substrate in such a layer thickness as to form a smooth and contiguous layer on the substrate. Advantageously, the lacquer layer is elastic, so as to avoid the formation of cracks in the lacquer layer through mechanical motions or swelling of the fibers, e.g. through moisture absorption. This has the advantage that the haptics typical of bank notes, i.e. the flexural stiffness and the sound, are retained longer under stress. This has a positive effect in particular under extreme climatic and mechanical stress. Preferably, the elastic lacquers comprise polyurethane systems which give the lacquer its elasticity. These are e.g. water-based dispersions of aliphatic polyester-polyurethanes, of aliphatic polyether-polyurethanes or acrylic-styrene polyurethanes. It will be appreciated that the required amount of coating here depends, inter alia, on the employed lacquer, the employed substrate material and its roughness and pore size and porosity factor. It has further turned out to be advantageous when the primer layer is present on the substrate in a coating weight of 1 to 8 g/m$^2$, preferably 2 to 6 g/m$^2$ (wet weight). In any case, the layer thicknesses must be sufficient to close the irregular depressions and pores of the planar substrate. The aqueous primer layer can optionally contain cross-linking agent, e.g. aziridine.

Suitable UV-cross-linking lacquer layers with high physical and chemical stability are known in the prior art (see e.g. EP 1 595 029 B1). The lacquer can in particular contain matting agent (e.g. 10 to 15 wt. %). With respect to the lacquer components of the UV-cross-linking third lacquer, suitable lacquer components are e.g. those described hereinabove with respect to the first lacquer. It is preferred that the UV-cross-linking third lacquer has silicones and/or waxes for improving the dirt-repellent properties. Besides radically cross-linking UV lacquers, there can also be used cationically cross-linking lacquer systems. The third lacquer can be present on the substrate in particular in a coating weight of 0.5 to 3 g/m$^2$, preferably 1 to 2 g/m$^2$. This corresponds to an amount of about 1 to 2 g/m$^2$ with respect to the preferred range in the un-cross-linked state, because UV systems are so-called "100% systems" (i.e. 100% solids content).

An example of a UV-cross-linking third lacquer can involve e.g. the above-described "composition 1", with matting agents being admixed in a proportion of 10 to 15 wt. %.

With respect to the application of the first lacquer and of the second lacquer, or of the first lacquer and of the water-based primer layer and of the third lacquer, to the security paper equipped with an anti-forgery means, three preferred variants are conceivable from the standpoint of process control:

Variant a)

Partially applying the first lacquer in the region of the anti-forgery means, followed by a spot coating with the second lacquer in the regions outside the anti-forgery means, so that the second lacquer partly overlaps the first lacquer. These operations are effected in the paper machine before the cross-cutter.

Variant b)

According to variant a), with the stated operations being effected outside the paper machine before the cross-cutter.

Variant c)

Partially applying the first lacquer in the region of the anti-forgery means in the paper machine before the cross-cutter. Applying the water-based primer layer in the regions outside the anti-forgery means, so that the primer layer partly overlaps the first lacquer. After printing the security paper above the primer layer, there is effected a final spot coating with the third lacquer as a dirt-repellent coating, so that the third lacquer covers the water-based primer layer.

With respect to the security-paper substrate there are no special limitations. Bank-note papers are typically manufactured from annual-plant fibers, in particular cotton fibers or cellulose fibers, but there can also be employed papers consisting at least partly of plastic fibers, preferably of polyamide fibers or polyester fibers. Particularly preferably, a cotton paper is employed as the security-paper substrate. The weight per unit area of the substrate varies according to the form of use. Usual weights per unit area lie in the range of 50 g/m$^2$ to 100 g/m$^2$, preferably in the range of 60 g/m$^2$ to 90 g/m$^2$, particularly preferably at about 70 g/m$^2$. In multi-ply substrates, the individual paper plies can consist of the same or different types of paper. For example, one paper ply can be a pure cotton paper, while a further paper ply has plastic fibers. Furthermore, the security-paper substrate used can also be a multi-ply paper/foil composite, such as a paper/foil/paper composite or a foil/paper/foil composite.

With respect to the manner of manufacturing the security-paper substrate there are no special restrictions either. The manufacture is preferably effected by means of a cylinder paper machine.

Further embodiment examples as well as advantages of the invention will be explained hereinafter with reference to the figures, in whose representation a rendition that is true to scale and to proportion has been dispensed with in order to increase the clearness.

BRIEF DESCRIPTION OF THE DRAWINGS

There are shown.

DETAILED DESCRIPTION OF VARIOUS EMBODIMENTS

Figure 1:
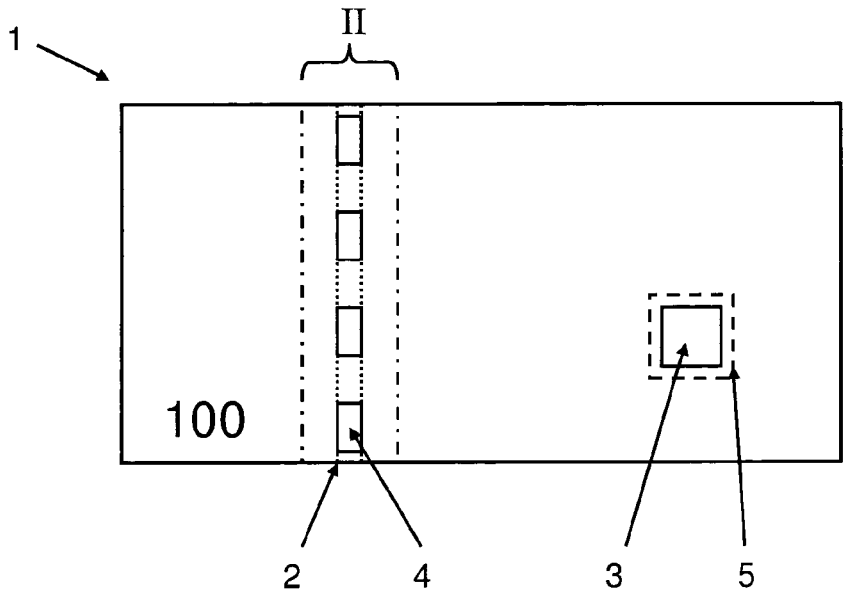
FIG. 1 a schematic representation of a security paper having an embedded windowed security thread and a glued-on, patch-shaped security element.

FIG. 1 shows a schematic representation of a security paper 1 which is furnished with an embedded windowed security thread 2 and a glued-on patch-shaped security element 3. The security paper 1 furthermore has the denomination "100" in the form of a watermark. The windowed security thread 2 (in the present case a microlens thread) and the security element 3 (in the present case a micro-optic representation arrangement with microstructures as well as concave micromirror arrays for magnified imaging of the microstructures) respectively convey a different pictorial impression to the viewer from different viewing angles. The windowed security thread 2 represented by dashed lines emerges on the surface of the security paper 1 at the window regions 4 while being embedded in the interior of the security paper 1 at the bar regions therebetween.

The patch-shaped security element 3 and the windowed security thread 2 are respectively furnished with a dirt-repellent radiation-curing first lacquer substantially not influencing the perceptibility of the optically variable effect. In the present example, the first lacquer is a UV lacquer based on the above-described composition 1, and is applied to the security paper in the regions 5 and II by flexographic printing or offset printing. The first lacquer is not applied above the anti-forgery means 2 and 3 in exact register, but rather the lacquer also covers bordering parts of the security-paper substrate that surround the anti-forgery means 2 and 3 and form, so to speak, edge regions for the anti-forgery means 2 and 3. The layer thickness of the first lacquer amounts to 1.5 μm in the present example.

The security paper 1 is furnished in its surface lying outside the anti-forgery means 2 and 3 over the full area with a dirt-repellent second lacquer which partly overlaps the first UV lacquer in the region of the partial substrate areas surrounding the anti-forgery means 2 and 3. In the present example, the dirt-repellent second lacquer is based on a physically drying aqueous dispersion lacquer, preferably applied by means of flexographic printing, according to the above-described composition 2.

The spatial arrangement of the first UV lacquer and of the second physically drying aqueous dispersion lacquer on the security paper 1, and the term "partly overlap", will be explained more closely hereinafter with respect to the anti-forgery means 2 with reference to FIGS. 2*a* to 2*c*.

Figure 2A:
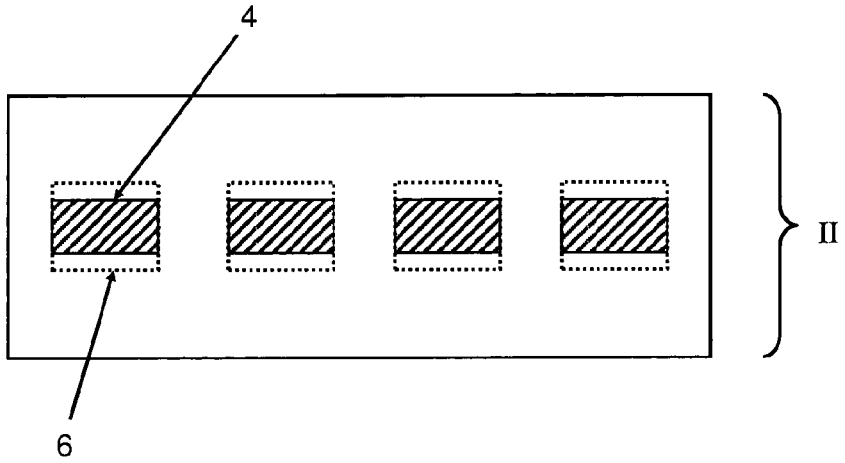
FIG. 2*a* the enlarged region II in plan view, with the wobble zone of the thread being schematically illustrated.

FIG. 2*a* shows the enlarged detail II of FIG. 1 in plan view. The windowed security thread 2 emerges on the surface of the security paper at the window regions 4 while being embedded in the interior of the security paper at the bar regions therebetween. In order to avoid unwanted thickening (and thus poor flatness of the paper sheets) at the places of the security thread when papers of value are stacked, the incorporating of the security thread into the paper during the paper manufacture is effected by means of the wobbling technique known in the prior art. The term "wobbling" designates in this connection a periodic fluctuation of the security thread upon embedding into the paper of several millimeters perpendicular to the thread direction, so as to form certain wobble zones 6 within which the security thread comes to lie.

Figure 2B:
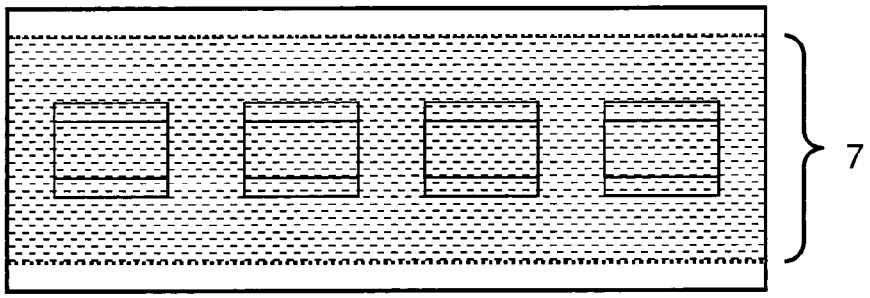
FIG. 2*b* the enlarged region II in plan view, with the extension of the first lacquer layer being schematically illustrated.
Figure 2C:
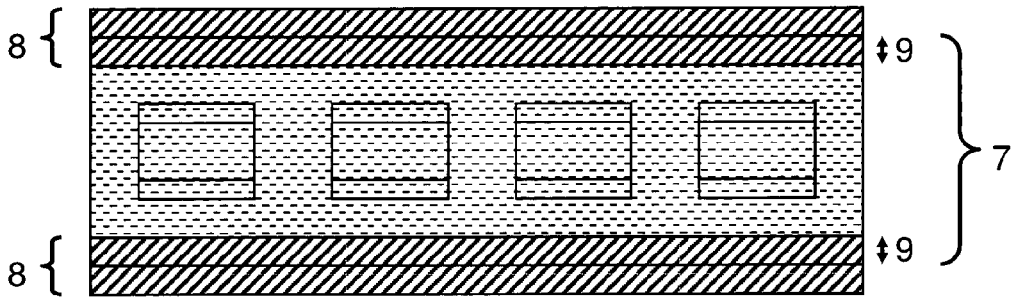
FIG. 2*c* the enlarged region II in plan view, with the extension of the second lacquer layer being schematically illustrated.

The windowed security thread 2 and a partial substrate area surrounding the windowed security thread 2 are furnished, for extending life and fitness for circulation, with the above-described dirt-repellent radiation-curing first lacquer 7 substantially not influencing the perceptibility of the optically variable security feature (see FIG. 2*b*).

The security paper 1 has on its surface lying outside the windowed security thread 2 the above-described dirt-repellent second lacquer 8 which partly overlaps the first lacquer 7 in the region of the partial substrate area surrounding the windowed security thread 2. The overlap regions are designated with the reference number 9 (see FIG. 2*c*).

The invention claimed is:

1. A security paper for making a value document and having a planar substrate which is equipped on at least one surface with at least one anti-forgery means, wherein the anti-forgery means comprises a carrier foil which is visually recognizable to a viewer at least in some regions and has an optically variable security feature, and the anti-forgery means and a partial substrate area surrounding the anti-forgery means are directly furnished, for extending life and fitness for circulation, with a dirt-repellent radiation-curing first lacquer which preserves perceptibility of the optically variable security feature, the layer thickness of said lacquer lying in a range of 0.7 to 2 μm, wherein the anti-forgery means is present in the form of a security strip or security thread being surrounded by the partial substrate area furnished with the first lacquer on two sides or in the form of a patch being surrounded by the partial substrate area furnished with the first lacquer on four sides, and wherein the partial substrate area surrounding the anti-forgery means has a width of 0.3 to 10 mm.

2. The security paper according to claim 1, wherein the radiation-curing first lacquer is a UV-cross-linked lacquer which is high-gloss.

3. The security paper according to claim 1, wherein the substrate is furnished on its surface lying outside the anti-forgery means with a water-based primer layer which optionally partly overlaps the dirt-repellent radiation-curing first lacquer, in the region of the partial substrate area surrounding the anti-forgery means, and the primer layer is optionally furnished with a UV-cross-linking lacquer forming a cover layer, which protects the substrate from physical and chemical influences.

4. The security paper according to claim 1, wherein the substrate is furnished on its surface lying outside the anti-forgery means with a dirt-repellent second lacquer which optionally partly overlaps the dirt-repellent radiation-curing first lacquer, in the region of the partial substrate area surrounding the anti-forgery means, and either (a) involves a physically drying, water-based dispersion lacquer which can optionally contain cross-linking agent and after drying has a matt impression having a gloss of less than 20 gloss units at 60°, measured by means of gloss meters according to DIN standard 67530, or (b) involves a UV-cross-linking lacquer which after cross-linking has a matt impression having a gloss of less than 20 gloss units at 60°, measured by means of gloss meters according to DIN standard 67530.

5. The security paper according to claim 4, wherein the dirt-repellent second lacquer involves a physically drying, water-based dispersion lacquer which cures through removal of the dispersant and is an aqueous dispersion of a polyacrylic resin and/or of a polyurethane resin.

6. A security paper according to claim 1, wherein the substrate is printed with signs or patterns on its surface lying outside the anti-forgery means or on the surface of a dirt-repellant second lacquer lying outside the anti-forgery means.

7. The security paper according to claim 6, wherein the substrate is furnished on its surface lying outside the anti-forgery means with a water-based primer layer which optionally partly overlaps the stated dirt-repellent radiation-curing first lacquer in the region of the partial substrate area surrounding the anti-forgery means, and the substrate is printed with signs or patterns, and the primer layer is furnished with a UV-cross-linking third lacquer forming a cover layer, which protects the substrate from physical and chemical influences.

8. The security paper according to claim 1, wherein the optically variable security feature has microstructures and micro-imaging elements for magnified imaging of the microstructures.

9. A security paper for making a value document and having a planar substrate which is equipped on at least one surface with at least one anti-forgery means, wherein the anti-forgery means comprises a carrier foil which is visually recognizable to a viewer at least in some regions and has an optically variable security feature, and the anti-forgery means and a partial substrate area surrounding the anti-forgery means are directly furnished, for extending life and fitness for circulation, with a dirt-repellent radiation-curing first lacquer which preserves perceptibility of the optically variable security feature, the layer thickness of said lacquer lying in a range of 0.7 to 2 μm, wherein the anti-forgery means is present in the form of a security strip or security thread being surrounded by the partial substrate area furnished with the first lacquer on two sides or in the form of a patch being surrounded by the partial substrate area furnished with the first lacquer on four sides, and wherein the partial substrate area surrounding the anti-forgery means has a width of 0.3 to 10 mm, and wherein the optically variable security feature has microstructures and micro-imaging elements for magnified imaging of the microstructures.

* * * * *